US007833136B2

(12) United States Patent
Bell

(10) Patent No.: US 7,833,136 B2
(45) Date of Patent: Nov. 16, 2010

(54) ROWING TRAINER

(76) Inventor: Edward J. Bell, 7 Grand Coach Ct., Medford, NJ (US) 08055

( * ) Notice: Subject to any disclaimer, the term of this patent is extended or adjusted under 35 U.S.C. 154(b) by 11 days.

(21) Appl. No.: 12/013,428

(22) Filed: Jan. 12, 2008

(65) Prior Publication Data

US 2009/0181832 A1 Jul. 16, 2009

(51) Int. Cl.
*A63B 69/06* (2006.01)
*A63B 21/00* (2006.01)

(52) U.S. Cl. ..... 482/72; 482/138

(58) Field of Classification Search ..... 482/72, 482/51, 138, 140
See application file for complete search history.

(56) References Cited

U.S. PATENT DOCUMENTS

| | | | | | |
|---|---|---|---|---|---|
| 182,023 | A | | 9/1876 | Isaacs | |
| 184,031 | A | | 11/1876 | Blakeman | |
| 209,960 | A | | 11/1878 | Davis | |
| 228,845 | A | | 6/1880 | Walthour | |
| 381,187 | A | | 4/1888 | Tracy | |
| 445,726 | A | | 2/1891 | Coop | |
| 641,596 | A | * | 1/1900 | Kerns | 482/72 |
| 1,111,269 | A | * | 9/1914 | Medart | 482/72 |
| 1,504,375 | A | * | 8/1924 | Phillips | 482/73 |
| 1,577,809 | A | * | 3/1926 | Randall | 482/72 |
| 1,707,791 | A | * | 4/1929 | Anderson | 482/72 |
| 1,905,092 | A | * | 4/1933 | Hardy | 482/72 |
| 1,974,445 | A | | 9/1934 | Calleson | |
| 2,586,024 | A | | 2/1952 | Glasgow | |
| 2,725,231 | A | | 11/1955 | Hoover | |
| 3,266,801 | A | * | 8/1966 | Johnson | 482/73 |
| 3,473,843 | A | * | 10/1969 | Hart | 297/130 |
| 3,528,653 | A | * | 9/1970 | Ross et al. | 482/72 |
| 3,572,700 | A | | 3/1971 | Mastropaolo | |
| 3,589,720 | A | * | 6/1971 | Agamian | 482/114 |
| 3,912,264 | A | * | 10/1975 | Busse et al. | 482/72 |
| 4,047,715 | A | | 9/1977 | Gjessing | |
| 4,396,188 | A | | 8/1983 | Dreissigacker | |
| 4,469,325 | A | | 9/1984 | Ware | |
| D277,304 | S | * | 1/1985 | Smith et al. | D21/674 |
| 4,508,385 | A | | 4/1985 | Bowman | |
| 4,550,908 | A | * | 11/1985 | Dixon | 482/113 |
| 4,563,000 | A | * | 1/1986 | Gall | 482/72 |
| D287,389 | S | * | 12/1986 | Nadeau | D21/674 |
| 4,684,126 | A | * | 8/1987 | Dalebout et al. | 482/138 |
| 4,695,050 | A | * | 9/1987 | Smith et al. | 482/73 |

(Continued)

OTHER PUBLICATIONS

Dictionary reference—Dictionary.com regarding definition of "affixed".*

(Continued)

*Primary Examiner*—Steve R Crow
*Assistant Examiner*—Robert F Long
(74) *Attorney, Agent, or Firm*—William H. Eilberg

(57) ABSTRACT

A rowing trainer includes a frame, and a seat affixed to the frame. A sliding rigger, which supports an oar assembly, is movable back and forth along the frame. The oars are indirectly connected to a cord which passes around at least one pulley, and which turns a flywheel. Neither the flywheel nor the seat translates relative to the frame. The only component which translates is the rigger and the associated oar assembly. The device closely simulates the experience of rowing an actual boat or scull.

12 Claims, 13 Drawing Sheets

U.S. PATENT DOCUMENTS 4,735,410 A * 4/1988 Nobuta ..... 482/9
4,743,010 A * 5/1988 Geraci ..... 482/72
4,743,011 A * 5/1988 Coffey ..... 482/73
4,746,112 A 5/1988 Fayal
4,750,736 A * 6/1988 Watterson ..... 482/73
D297,853 S * 9/1988 Ostrom ..... D21/674
4,798,378 A 1/1989 Jones
4,846,460 A 7/1989 Duke
4,875,674 A 10/1989 Dreissigacker
4,880,224 A 11/1989 Jonas
4,884,800 A 12/1989 Duke
4,889,509 A 12/1989 Pohlus
D306,750 S * 3/1990 Kiiski ..... D21/674
4,940,227 A * 7/1990 Coffey ..... 482/73
4,974,832 A * 12/1990 Dalebout ..... 482/72
4,984,986 A * 1/1991 Vohnout ..... 434/247
4,997,181 A 3/1991 Lo
5,013,033 A 5/1991 Watterson
5,072,929 A 12/1991 Peterson
5,092,581 A 3/1992 Koz
5,094,446 A 3/1992 Wiedner
5,104,363 A * 4/1992 Shi ..... 482/73
D337,799 S * 7/1993 Cutter et al. ..... D21/674
5,295,931 A * 3/1994 Dreibelbis et al. ..... 482/72
5,342,266 A * 8/1994 Dailey ..... 482/71
D354,099 S * 1/1995 Gerschefske et al. ..... D21/668
5,387,169 A * 2/1995 Wang ..... 482/73
D357,041 S * 4/1995 McBride et al. ..... D21/676
5,407,409 A * 4/1995 Tang ..... 482/70
D358,624 S * 5/1995 Wang et al. ..... D21/673
5,441,469 A * 8/1995 Chern ..... 482/72
D362,283 S * 9/1995 Lee ..... D21/674
5,478,296 A * 12/1995 Lee ..... 482/73
5,505,679 A * 4/1996 McBride et al. ..... 482/53
5,554,086 A * 9/1996 Habing et al. ..... 482/137
D375,767 S * 11/1996 Camfield et al. ..... D21/668
5,575,740 A * 11/1996 Piaget et al. ..... 482/70
5,580,340 A * 12/1996 Yu ..... 482/96
D378,110 S * 2/1997 Collinsworth ..... D21/690
5,611,758 A * 3/1997 Rodgers, Jr. ..... 482/57
5,707,322 A 1/1998 Dreissigacker
D390,289 S * 2/1998 Chen ..... D21/668
5,722,921 A * 3/1998 Simonson ..... 482/100
5,779,600 A * 7/1998 Pape ..... 482/72
5,795,270 A * 8/1998 Woods et al. ..... 482/72
D397,745 S * 9/1998 Wu ..... D21/668
5,833,256 A 11/1998 Gilmore
D414,519 S * 9/1999 Wang et al. ..... D21/676
D425,585 S * 5/2000 Wu ..... D21/676
6,071,215 A * 6/2000 Raffo et al. ..... 482/57
6,093,135 A * 7/2000 Huang ..... 482/72
6,135,930 A * 10/2000 Kuo ..... 482/72
6,196,954 B1 * 3/2001 Chen ..... 482/131
6,224,519 B1 * 5/2001 Doolittle ..... 482/98
6,361,479 B1 * 3/2002 Hildebrandt et al. ..... 482/72
6,371,892 B1 4/2002 Dreissigacker
6,371,895 B1 * 4/2002 Endelman et al. ..... 482/135
6,540,650 B1 * 4/2003 Krull ..... 482/107
6,565,495 B2 * 5/2003 Slattery ..... 482/142
6,602,168 B2 * 8/2003 Duke ..... 482/72
6,692,410 B1 * 2/2004 Lai ..... 482/52
6,817,968 B2 * 11/2004 Galbraith et al. ..... 482/72
6,981,932 B1 * 1/2006 Huang et al. ..... 482/72
7,022,052 B1 * 4/2006 Lai ..... 482/72
7,207,853 B2 * 4/2007 Spencert et al. ..... 440/21
7,232,404 B2 * 6/2007 Nelson ..... 482/140
7,252,627 B2 * 8/2007 Carter ..... 482/98
7,413,532 B1 * 8/2008 Monsrud et al. ..... 482/99
7,455,633 B2 * 11/2008 Brown et al. ..... 482/142
D584,367 S * 1/2009 Augustine et al. ..... D21/662
7,731,637 B2 * 6/2010 D'Eredita ..... 482/72
2001/0027150 A1 * 10/2001 Duke ..... 482/72
2002/0151415 A1 * 10/2002 Hildebrandt et al. ..... 482/57
2003/0045406 A1 * 3/2003 Stone ..... 482/100
2004/0009849 A1 * 1/2004 Galbraith et al. ..... 482/72
2005/0032611 A1 * 2/2005 Webber et al. ..... 482/72
2005/0130810 A1 * 6/2005 Sands ..... 482/72
2005/0170711 A1 * 8/2005 Spencer et al. ..... 440/21
2005/0277521 A1 * 12/2005 Lat ..... 482/72
2006/0166798 A1 * 7/2006 Nelson ..... 482/140
2007/0082793 A1 * 4/2007 Yang ..... 482/72
2007/0149370 A1 * 6/2007 Brown et al. ..... 482/140
2007/0197347 A1 * 8/2007 Roach ..... 482/72
2008/0070765 A1 * 3/2008 Brown et al. ..... 482/140
2008/0070766 A1 * 3/2008 Brown et al. ..... 482/140
2008/0125291 A1 * 5/2008 Watt et al. ..... 482/52
2008/0280736 A1 * 11/2008 D'Eredita ..... 482/72
2008/0305934 A1 * 12/2008 Medina ..... 482/72
2009/0018000 A1 * 1/2009 Brown et al. ..... 482/140

OTHER PUBLICATIONS

Rowing exercisers patent history archive internet link—http://www.rowinghistory.net/patents.htm.*
Rowperfect (web page www.rowperfect.com).

* cited by examiner

ROWING TRAINER

BACKGROUND OF THE INVENTION

The present invention relates to the field of athletics training, and provides a rowing machine which closely simulates the feel of a scull or boat.

Rowing machines have been known for many years. Examples of such machines are shown in U.S. Pat. Nos. 228,845, 381,187, 641,596, 1,504,375, 2,586,024, 3,572,700, 4,047,715, 4,396,188, 4,743,011, 4,846,460, 4,880,224, 4,884,800, 4,984,986, 5,013,033, 5,092,581, 5,295,931, 5,441,469, and 5,779,600. The disclosures of the above-cited patents are incorporated by reference herein.

Rowing machines are used by the majority of rowing clubs and teams to improve fitness during inclement weather, as well as to supplement rowing training when there are a large number of athletes and insufficient coaches.

A typical rowing machine of the prior art has a sliding seat which moves along the longitudinal axis of a simulated boat. In an actual racing scull or boat, the seat is movable along a pair of tracks, so that the seat slides during each rowing stroke.

As the scull or boat moves through the water, its center of gravity translates with the athlete. The boat may weigh as little as thirty pounds, and may thus constitute only about 10-15% of the total mass of the system which includes the boat and the athlete. In relation to the motion of the center of mass of the entire system, it is more accurate to describe the boat as translating with respect to the athlete, than to characterize the athlete as moving on the slide.

Although rowing machines of the prior art have generally used a sliding seat to accommodate the rowing motion, they do not accurately reproduce the "feel" of the boat. Rowing machines typically incline the tracks, within which the seat translates, to simulate the actual feel of the boat, as the athlete progresses through a stroke.

Some of the rowing machines of the prior art do not simulate the motion of the oars about an oar lock, and therefore do not exercise the same muscles that would be used in actual rowing. In such cases, the athlete must deal with an abrupt transition between what is experienced during training and what is felt during actual rowing.

The present invention provides a rowing trainer which more closely simulates the actual experience of rowing a scull or boat. The device of the present invention also accurately simulates the movement of the oars. It also enables the athlete to monitor the progress of the rowing activity.

SUMMARY OF THE INVENTION

The present invention comprises a rowing trainer having a frame and a seat which is affixed to the frame. The seat does not move relative to the frame when the rowing trainer is in use. The device further includes a rigger which supports an oar assembly, the rigger being slidable relative to the frame. The device also includes at least one flywheel, mounted to the frame, such that the flywheel does not translate relative to the frame.

The oar assembly includes at least one oar which is connected, by a link, to an underframe arm, the link being held within a hollow tube that is rigidly connected to a frame of the rigger. Pulling on the oar rotates the link, and therefore causes the underframe arm to rotate, in a manner similar to that of the oar.

The underframe arm has a free end to which there is attached a cord. The cord passes around a castering pulley, which is attached to the rigger, and then around a pulley or sprocket positioned at or near the flywheel. The cord then extends substantially the length of the frame, and is attached to the frame, preferably through a spring or other elastic component. When the athlete pulls the oar, the energy of the oar is transmitted to the underframe arm, through the cord, and to the flywheel.

The rigger preferably includes a foot rest, which translates with the rigger, relative to the frame. Thus, not only does the athlete push and pull on the oars, but the athlete also pushes on the foot rest, which will move back and forth with the rigger.

The rowing trainer of the present invention may also include a monitor or display screen, mounted to the frame, and positioned to be visible by the athlete using the machine. The monitor may display a comparison of the rotational velocities of two flywheels, to show the athlete the trajectory of the simulated boat.

The rowing trainer thus described minimizes the amount of energy consumed during the rowing operation, insofar as the majority of the mass of the athlete's body does not move during the rowing stroke, due to the fact that the seat is stationary. The only component which exhibits translational motion relative to the frame is the rigger and oar assembly. The motion of the flywheel is rotational only; the flywheel does not translate relative to the frame.

The invention also includes the method of operating the rowing trainer described above.

The present invention therefore has the primary object of providing a rowing trainer.

The invention has the further object of providing a rowing trainer which closely simulates the experience of rowing a boat or scull.

The invention has the further object of providing a rowing trainer which minimizes the energy expended in moving the athlete's body.

The invention has the further object of providing a rowing trainer with a non-translating flywheel, so that work can be performed in turning the flywheel by operation of the oars.

The invention has the further object of providing a rowing trainer which can be made with either one or two oars.

The invention has the further object of providing a rowing trainer which displays, to the user, information concerning the rowing operation.

The invention has the further object of providing a method of operating a rowing trainer.

The reader skilled in the art will recognize other objects and advantages of the present invention, from a reading of the following brief description of the drawings, the detailed description of the invention, and the appended claims.

DETAILED DESCRIPTION OF THE INVENTION

The present invention comprises a rowing trainer which simulates the actual experience of rowing a scull or boat.

Figure 1A:
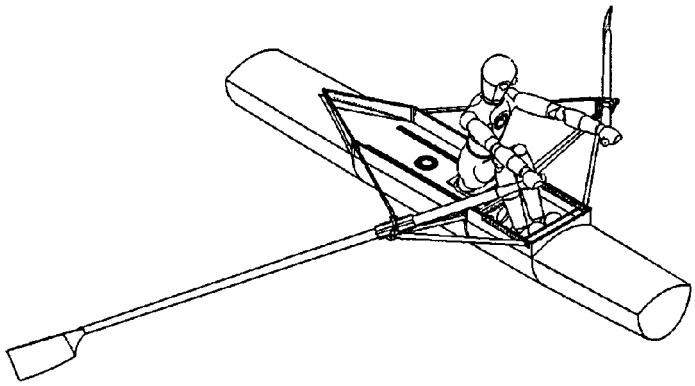
Fig. 1a Prior Art
FIGS. 1*a*, 1*b*, and 1*c* provide perspective views illustrating the three basic components of a rowing stroke, in the prior art.
Figure 1B:
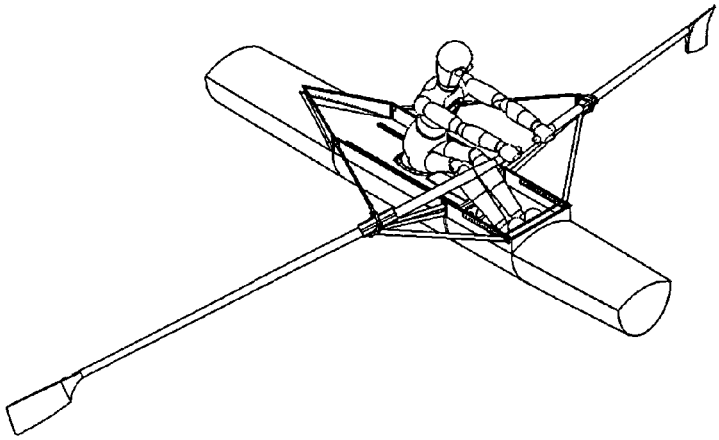
Fig. 1b Prior Art
Figure 1C:
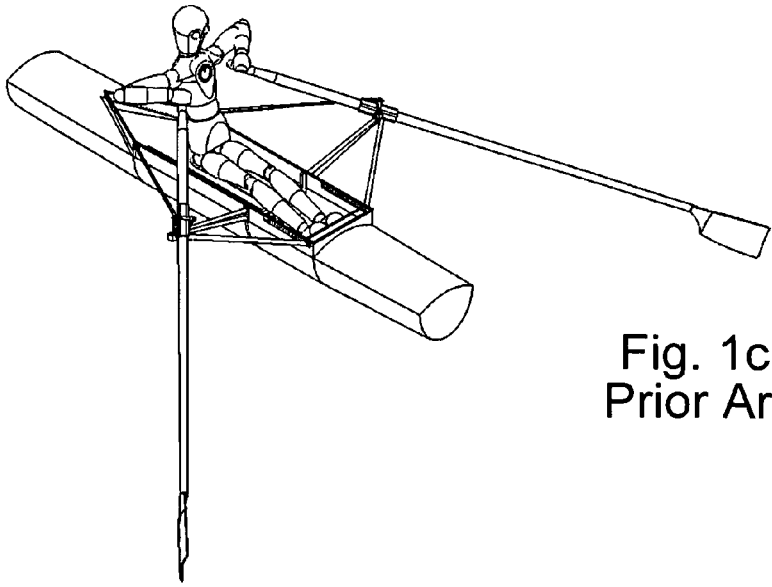
Fig. 1c Prior Art

FIGS. 1*a*-1*c* illustrate the three major stages of a rowing stroke. These stages are labeled "catch", "drive", and "finish", and apply both to the prior art and to the present invention. Reference will be made, later, to these stages, in describing the device of the present invention.

FIG. 1*a* shows a rower in a scull or boat, in the "catch" position. In this position, the athlete's legs are compressed, and the arms are extended. The oars are about to engage the water to perform the work of rowing.

FIG. 1*b* shows the rower in the "drive" position. The athlete's legs are nearly extended, and the arms are beginning to bend. This is the portion of the stroke which accomplishes most or all of the work of rowing, as the oars are moved through the water, with the oar blades oriented for maximum engagement with the water.

FIG. 1*c* shows the rower in the "finish" position. The athlete's legs are extended, the arms are bent, and the oar grips are at the athlete's side. The work of the rowing stroke has been completed.

Figure 2:
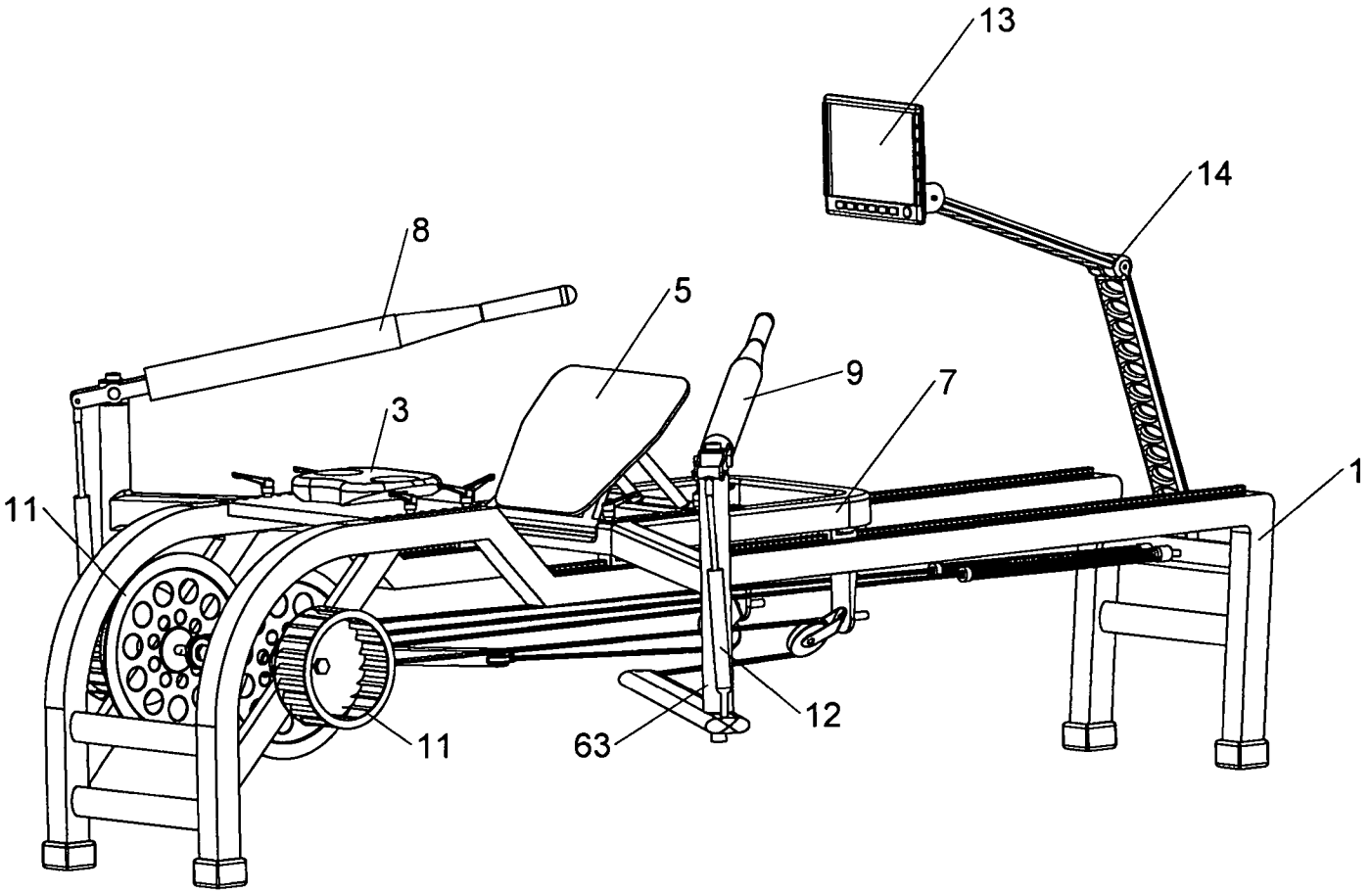
FIG. 2 provides a perspective view of the rowing trainer of the present invention.
Figure 3:
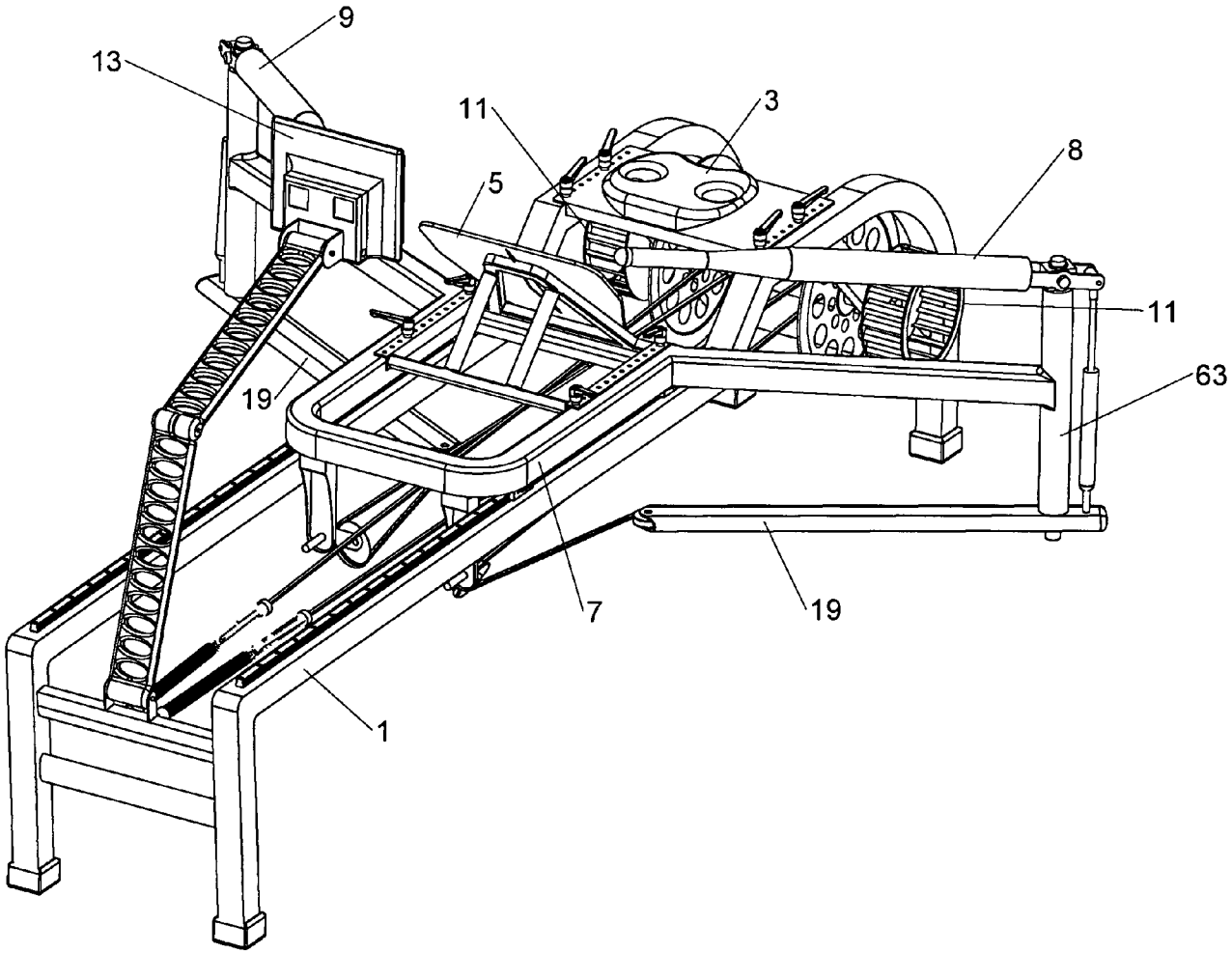
FIG. 3 provides a perspective view of the rowing trainer of the present invention, the view being taken from a direction which is generally opposite to that of FIG. 2.
Figure 4:
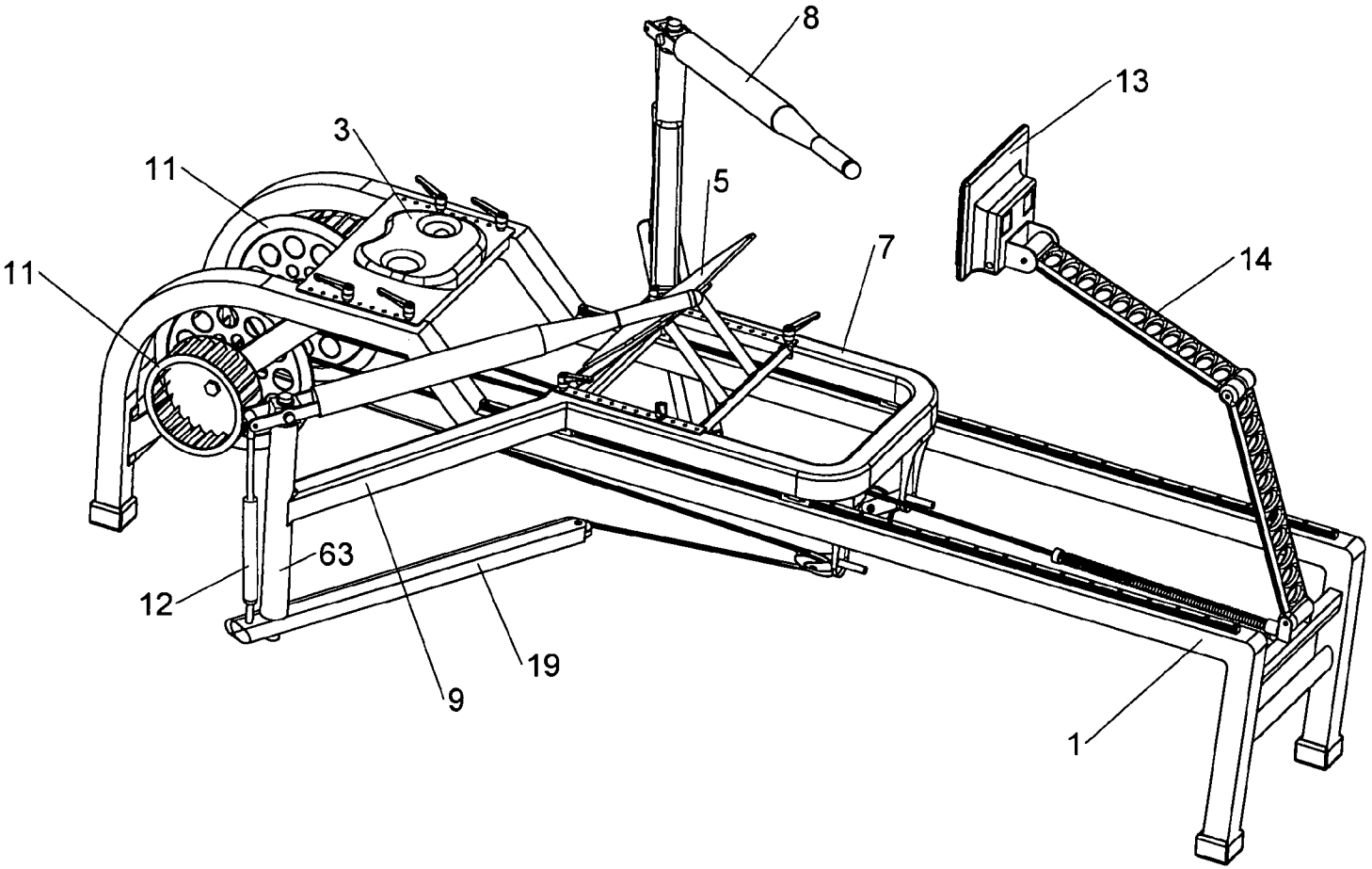
FIG. 4 provides another perspective view of the rowing trainer of the present invention.

FIGS. 2, 3, and 4 provide perspective views of the rowing trainer of the present invention, taken from different directions. The rowing trainer includes frame 1 and seat 3, the seat being affixed to the frame. The seat does not move relative to the frame during the rowing operation. Also, the frame is stationary with respect to the ground. A rigger 7, which slides back and forth along the length of the frame, supports an assembly for holding oars 8 and 9, and also supports foot rest 5, which comprises a generally flat plate inclined from the horizontal. The rigger also provides partial support for a system of cords, to be described later.

Although the seat does not move relative to the frame while the rowing trainer is in use, the seat may be made adjustable, so that its position along the frame may be changed, to suit the preferences of an individual user. However, the movement of the seat occurs only while the device is not in use. When actual rowing is in progress, the seat remains fixed relative to the frame.

The foot rest may be provided with one or more straps or shoes (not shown) to secure the athlete's foot to the foot rest during the rowing operation. Such straps or shoes enable the athlete to pull the rigger simply by moving his or her feet towards the seat. Straps and shoes, attached to a foot rest of a rowing machine, are well known in the art, and are therefore not shown in the drawings.

The cords are visible, in part, in FIGS. 2-4. The cords comprise means for transmitting energy from the oars to a pair of flywheels 11. The flywheels are affixed to the frame, and do not translate relative to the frame. That is, the motion of the flywheels is entirely rotational, and not translational. The purpose of the flywheels is to provide resistance to the rowing stroke, so as to simulate the experience of actual rowing. More details of the arrangement of the cords are given later.

Monitor 13 may be mounted on the frame, through flexible mount 14, for the purpose of providing feedback to the athlete regarding the progress of the rowing activity. One type of such feedback could include information about whether the simulated boat is turning. To provide such feedback, the flywheels can be connected to encoders, or their equivalents, and the angular displacements, or velocities, or both, of the flywheels can be calculated by a computer, and compared. If the flywheels are turning at different rates, the computer can be programmed to indicate, either graphically or numerically, or both, through monitor or display screen 13, that the simulated boat is not traveling along a straight line.

FIG. 4 also shows oar leveler 12, which is optionally included with the oars. The oar leveler comprises a piston and cylinder combination which adjusts the orientation of the oar relative to underframe arm 19.

Figure 5:
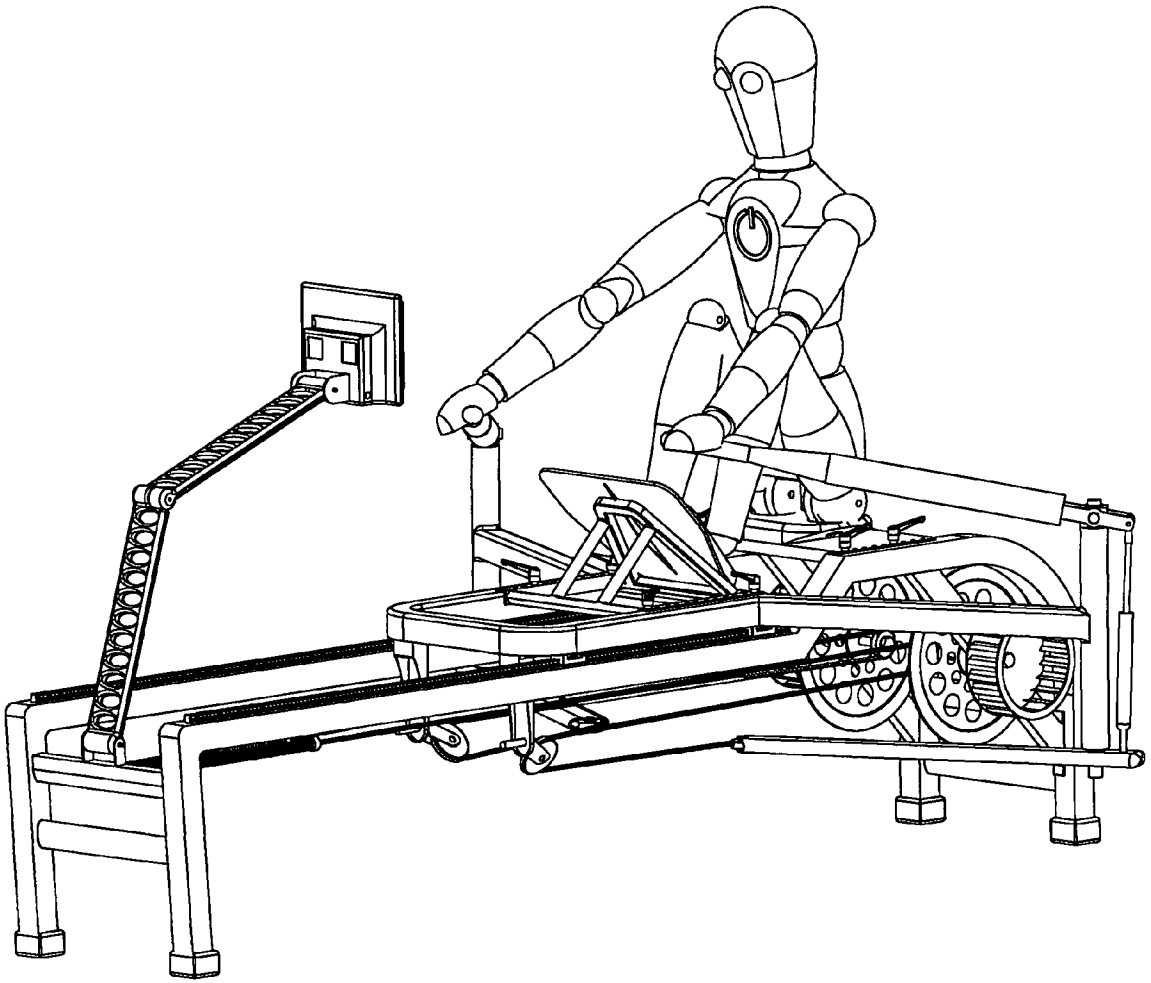
FIG. 5 provides a perspective view of the rowing trainer of the present invention, and also showing an athlete seated on the device.

FIG. 5 shows the rowing trainer of the present invention, with an athlete using the device. The view shown is generally similar to that of FIG. 3. The athlete sits on the seat, and grasps the ends of the oars, while pushing on the foot rest with his or her feet.

Figure 6:
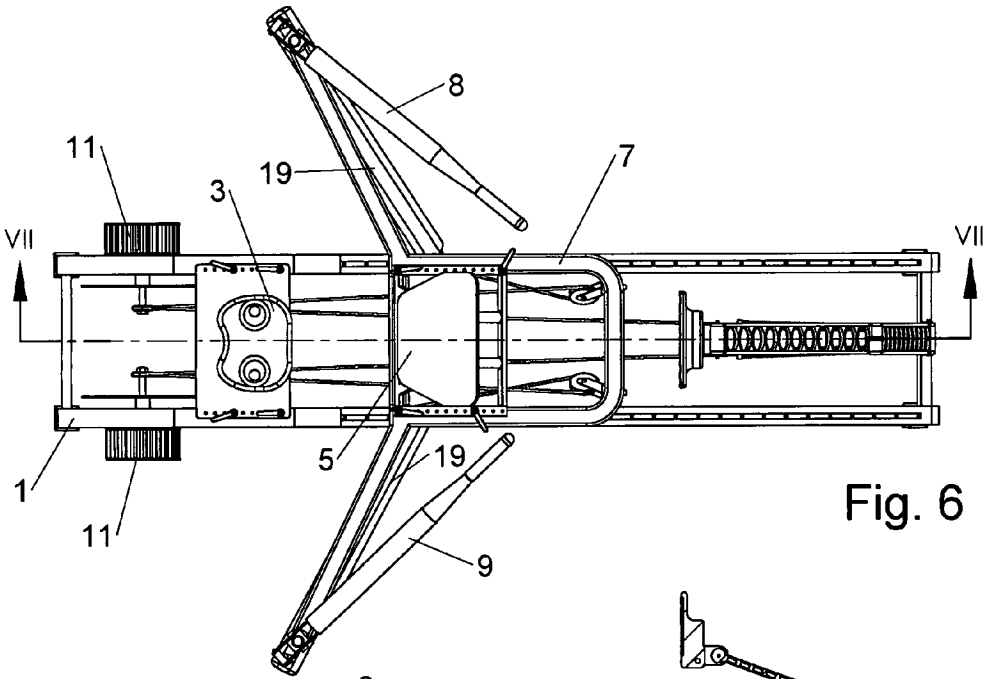
FIG. 6 provides a top view of the rowing trainer of the present invention.
Figure 7:
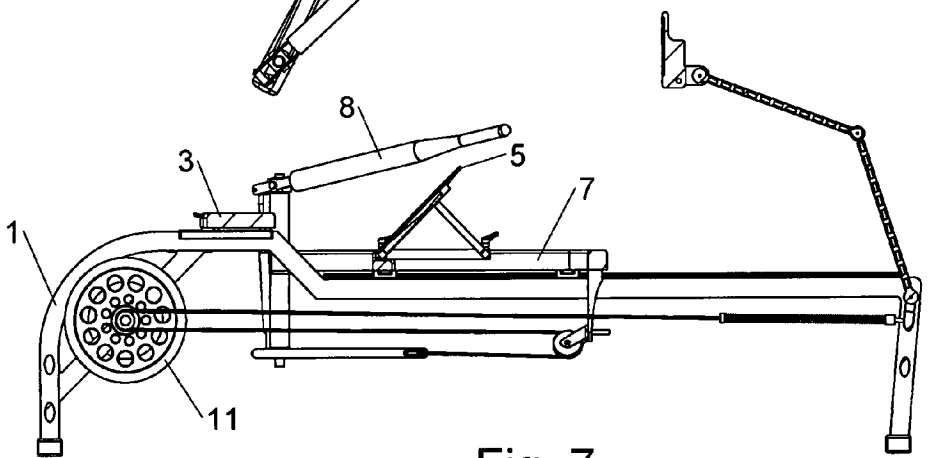
FIG. 7 provides a cross-sectional view of the rowing trainer of the present invention, taken along the line VII-VII of FIG. 5.

The rowing trainer of the present invention is shown further in the top view of FIG. 6 and the cross-sectional view of FIG. 7. FIG. 6 clearly illustrates frame 1, seat 3, rigger 7, oars 8 and 9, foot rest 5, and flywheels 11.

Figure 8:
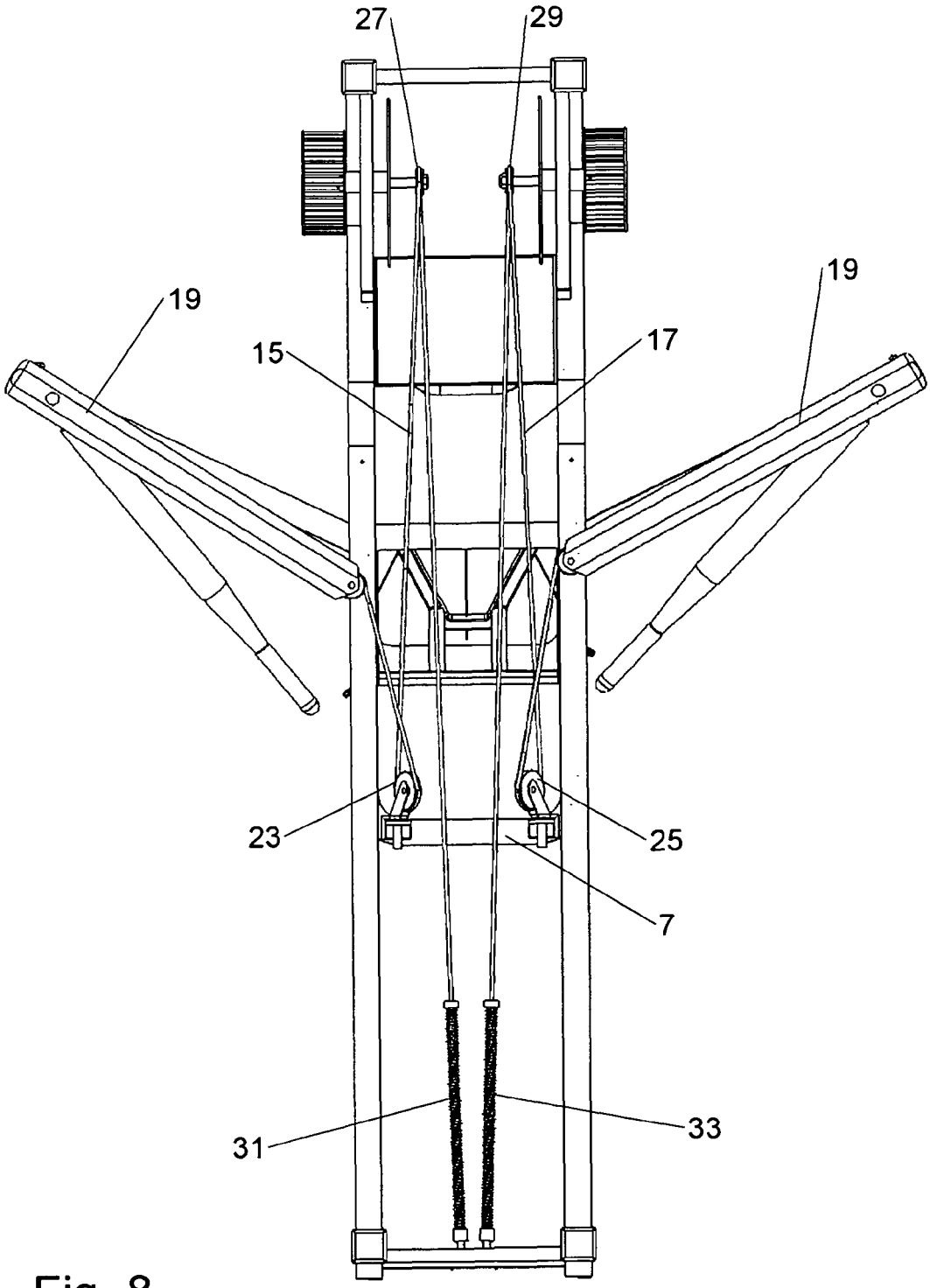
FIG. 8 provides a bottom view of the rowing trainer of the present invention.

FIG. 8 provides a bottom view of the rowing trainer of the present invention, and provides a more complete view of the arrangement of the cords. As shown in FIG. 8, cords 15 and 17 are affixed, at one end, to the free ends of underframe arms 19, which arms are pivotally connected, through vertical links, to be described later, to the respective oars. The cords pass around castering pulleys 23 and 25, the castering pulleys being attached to the rigger. The castering pulleys thus translate with the rigger. The cords then pass around flywheel pulleys or sprockets 27 and 29, and then extend substantially the length of the frame, where they are connected to the frame through springs 31 and 33. The spring could be replaced by a block and tackle mechanism using a bungee cord.

Figure 9:
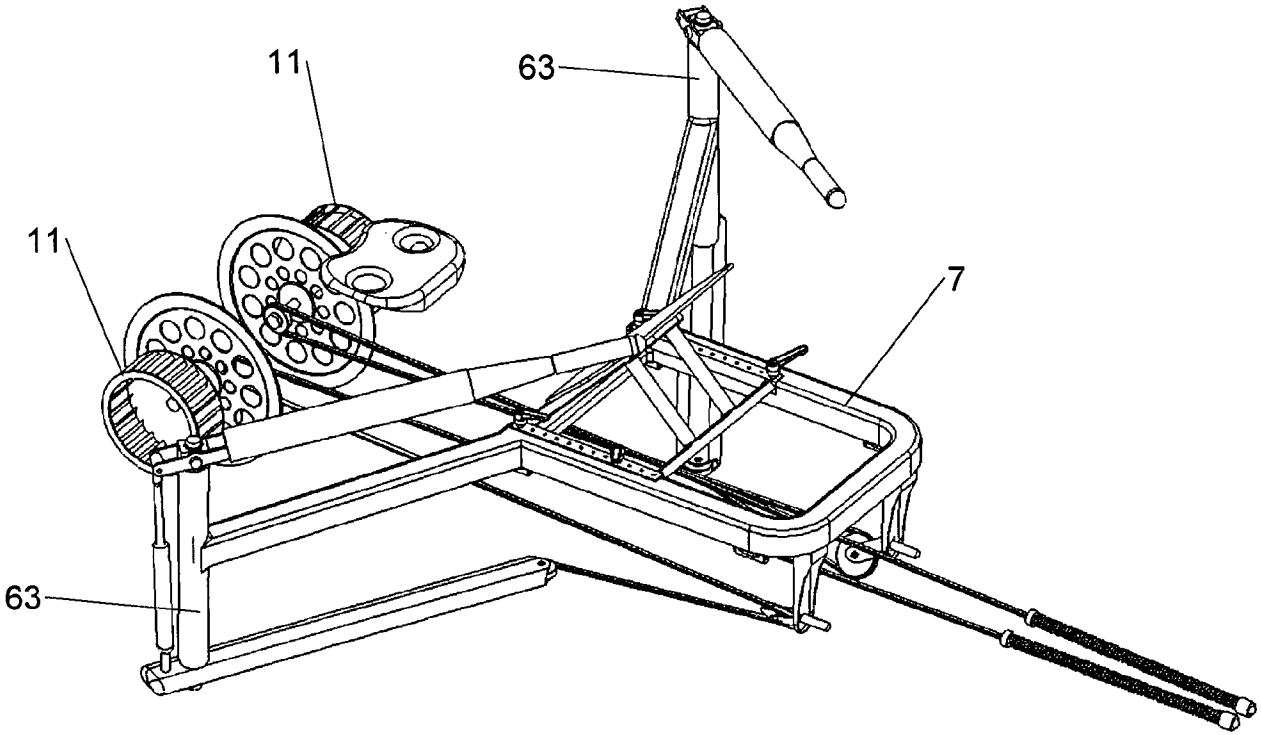
FIG. 9 provides a perspective view of portions of the rowing trainer of the present invention, showing the connections of the cords and flywheels.

FIG. 9 illustrates the transmission portion of the rowing trainer of the present invention. In particular, FIG. 9 shows the path of the cords, as they extend from the free ends of the underframe arms, around the castering pulleys, around the flywheel pulleys, and along the length of the frame (the frame being omitted in FIG. 9) to the springs.

Figure 10:
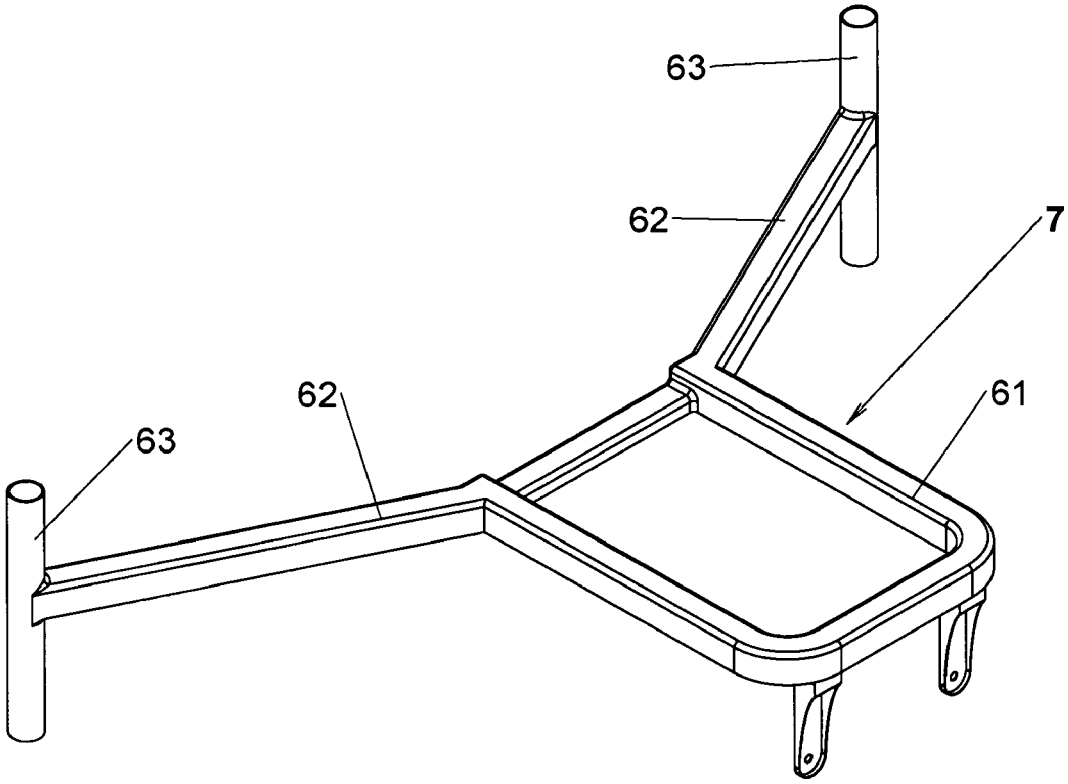
FIG. 10 provides a perspective view of the frame of the rigger used in the present invention.

FIG. 10 provides a perspective view of the frame of the rigger 7. The rigger frame includes a generally rectangular portion 61, a pair of outwardly extending arms 62, and a pair of hollow tubes 63, the tubes being rigidly affixed to the arms 62. The rectangular portion 61 is the component of the rigger which comprises means for engaging the frame.

The frame of the rigger is intended to be a single, rigid component. In practice, it may be formed of various pieces that are welded together, like a bicycle frame.

Figure 11:
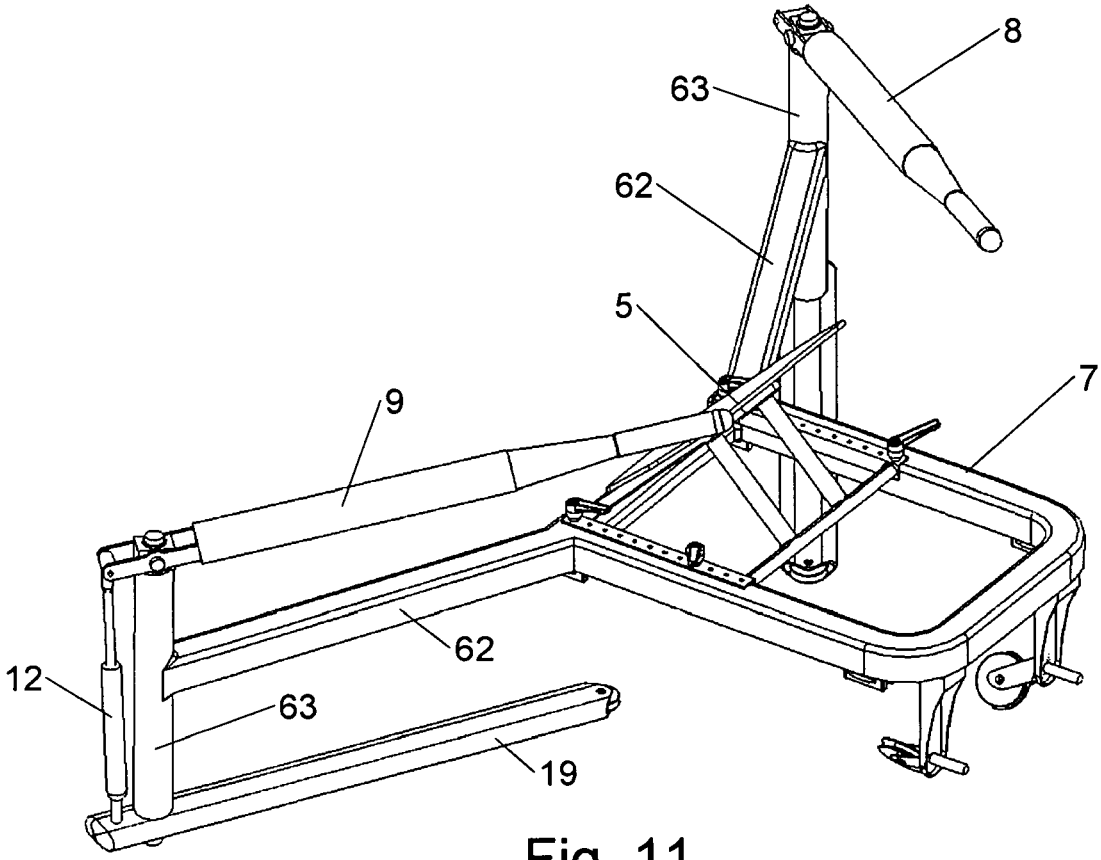
FIG. 11 provides a perspective view of the entire rigger and oar system of the present invention.
Figure 12:
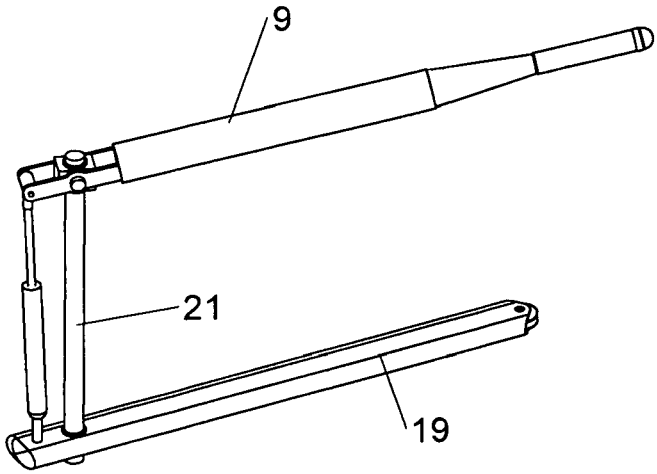
FIG. 12 provides a fragmentary perspective view, showing an oar connected by a link to its associated underframe arm, as used in the present invention.

FIG. 11 provides a perspective view, showing the rigger and the oars, as well as foot rest 5. FIG. 12 provides a detail showing oar 9 and underframe arm 19 connected by vertical link 21. The vertical link fits within tube 63. In the other figures, such as in FIGS. 2-5, the vertical links are not visible, as they are entirely contained within tubes 63.

Because the rigger frame is a rigid structure, the angle formed by the arms 62, relative to the rectangular portion 61, is fixed. Thus, throughout the rowing stroke, the tubes, and thus the vertical links, are located at a fixed position relative to the rigger, and translate back and forth with the motion of the rigger.

As the sliding rigger translates, the athlete is pulling on the grip portions of the oars, and the work applied to the grip portions rotates the vertical links 21. The vertical links cause movement of underframe arms 19, such that the underframe arms move at substantially the same angular velocity as the oars. The underframe arms pull the cords which are looped around the castering pulleys, thereby redirecting tension in the cords to the flywheel pulleys, thus rotating the flywheels.

Figure 15A:
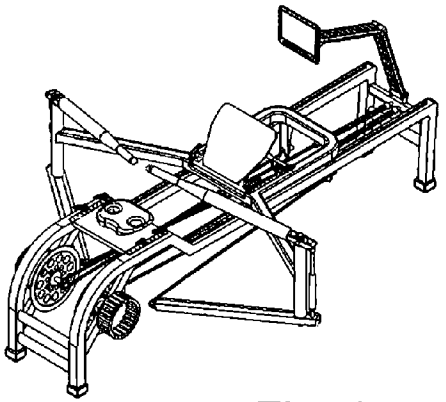
FIGS. 15*a* and 15*b* provide, respectively, a perspective view and a top view, of the rowing trainer of the present invention, in the "finish" position of the stroke.
Figure 15B:
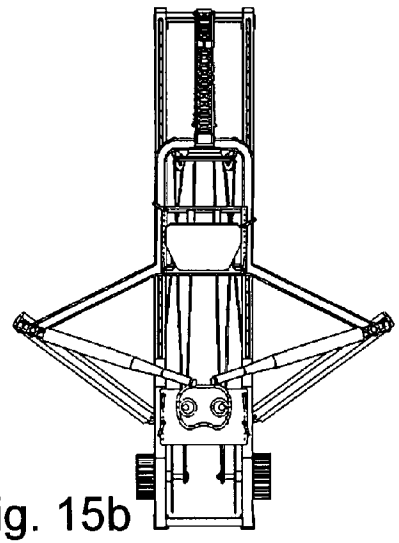
Figure 14A:
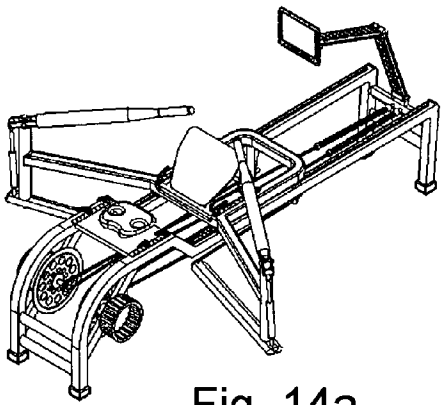
FIGS. 14*a* and 14*b* provide, respectively, a perspective view and a top view, of the rowing trainer of the present invention, in the "drive" position of the stroke.
Figure 14B:
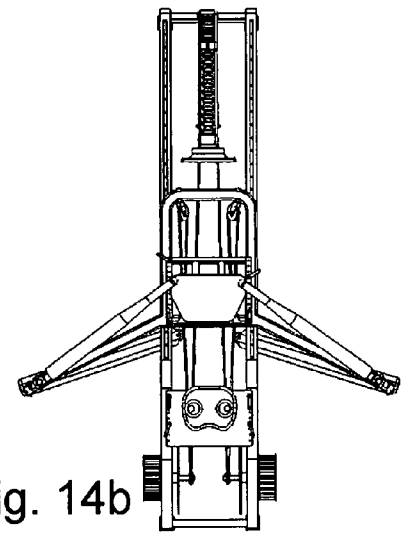
Figure 13A:
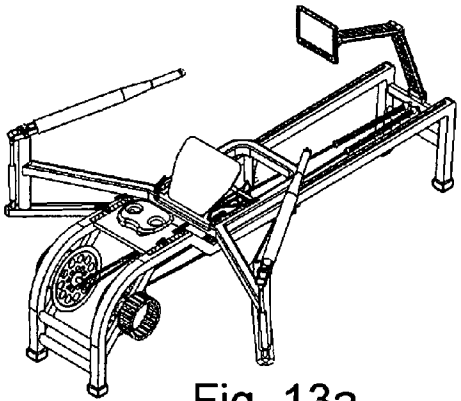
FIGS. 13*a* and 13*b* provide, respectively, a perspective view and a top view, of the rowing trainer of the present invention, in the "catch" position of the stroke.
Figure 13B:
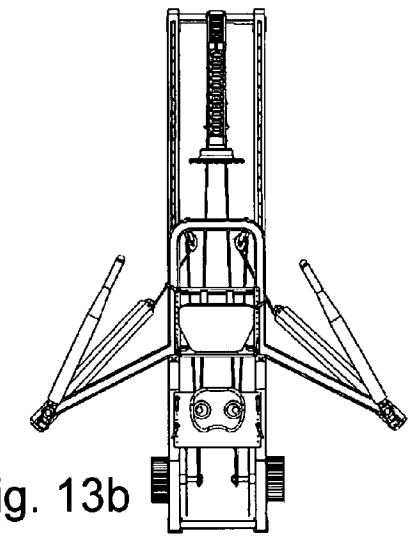

FIGS. 13*a* and 13*b* provide perspective and top views, respectively, of the rowing trainer of the present invention in the "catch" position. FIGS. 14*a* and 14*b* provide perspective and top views, respectively, of the rowing trainer of the present invention in the "drive" position. During the "drive" stroke, the sliding rigger moves away from the seat, the seat being stationary with respect to the frame. FIGS. 15*a* and 15*b* provide perspective and top views, respectively, of the rowing trainer of the present invention in the "finish" position.

Figure 16:
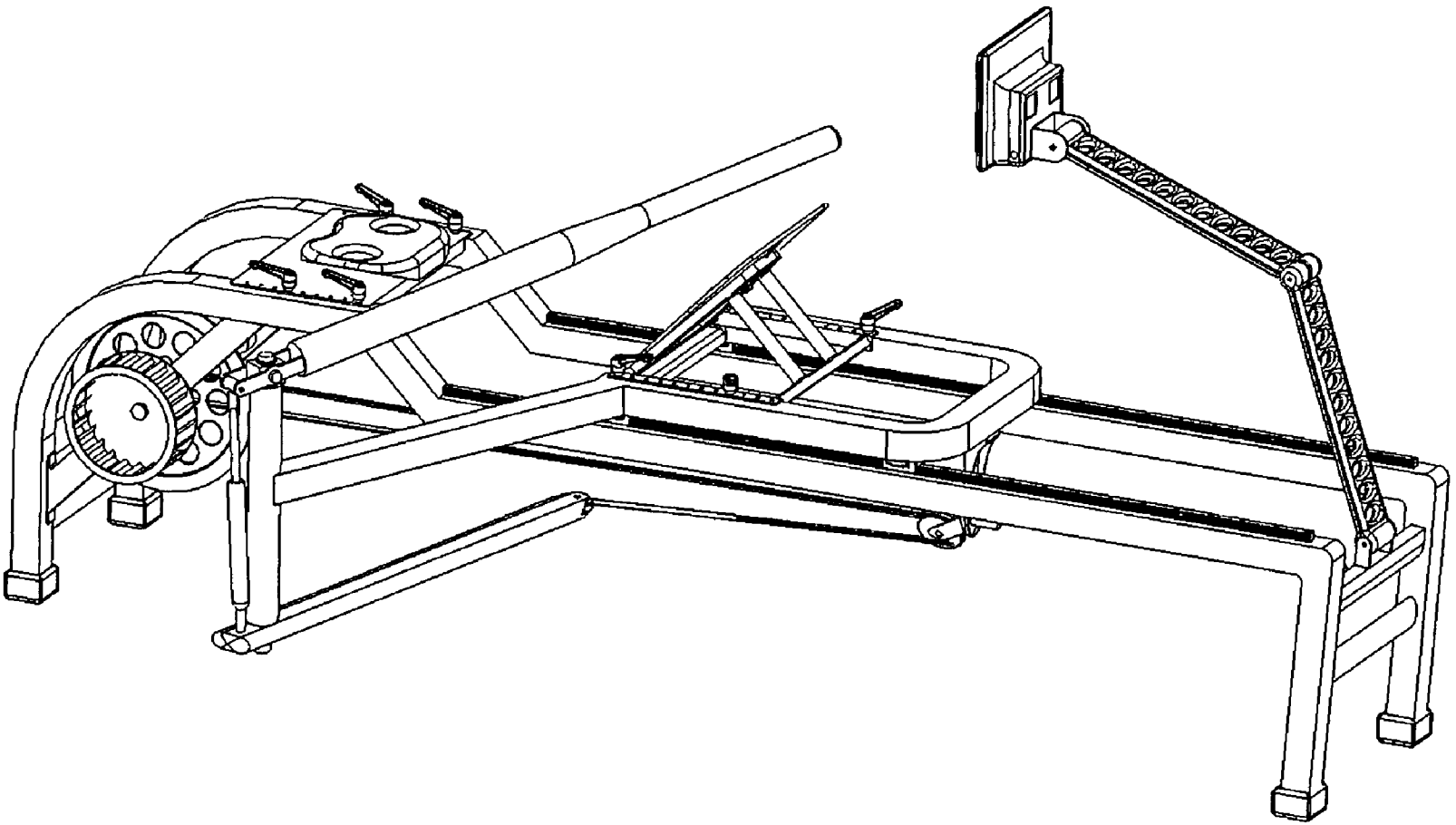
FIG. 16 provides a perspective view of an alternative embodiment of the present invention, in which there is only one oar.

FIG. 16 provides a perspective view of an alternative embodiment of the rowing trainer of the present invention, wherein there is only one oar. In this embodiment, the oar is bigger than the oars in the two-oared embodiment, as it is intended that the athlete place two hands on this single oar. But the device otherwise operates in substantially the same way as the two-oared embodiment.

In either or both of the single-oar and double-oar embodiments of the present invention, the oar can be provided with the oar handle described in U.S. Pat. No. 6,126,500, the disclosure of which is incorporated by reference herein.

Figure 17:
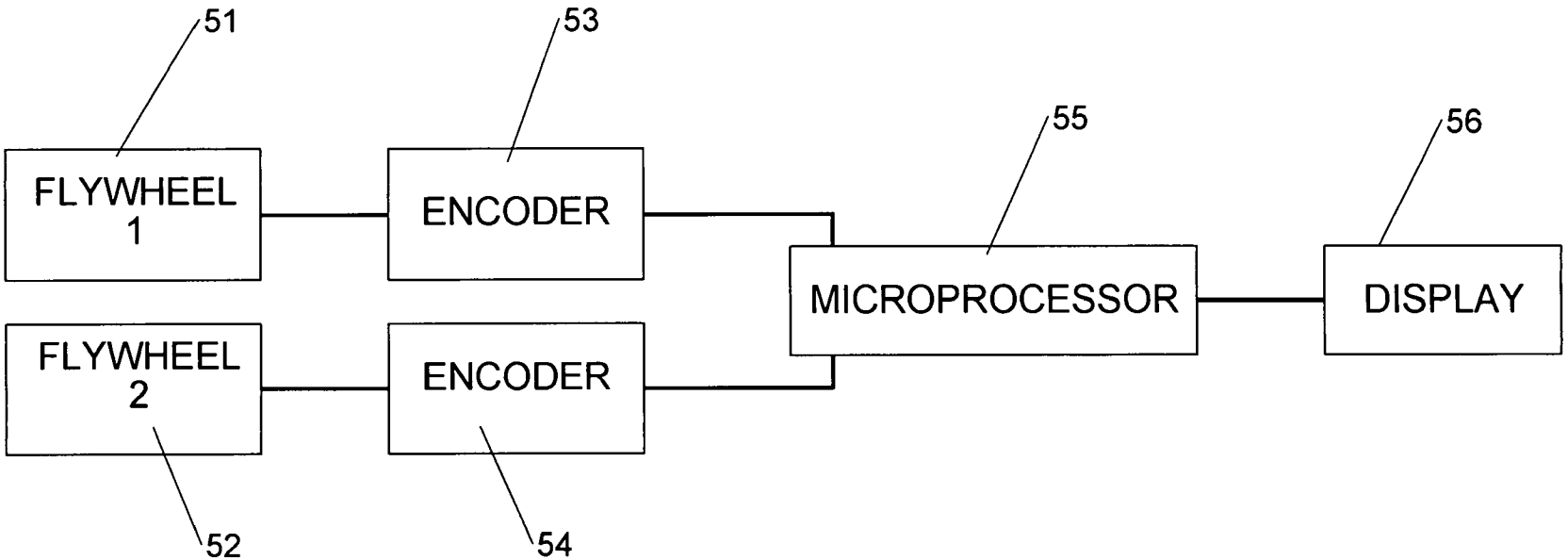
FIG. 17 provides a block diagram showing the connection of the flywheels to a computer, so as to enable real-time monitoring of the rowing action, in the present invention.

FIG. 17 provides a block diagram of the circuitry used for monitoring the performance of the athlete using the rowing trainer of the present invention. Flywheels 51 and 52 are connected, respectively, to encoders 53 and 54, which encode the angular displacements of the flywheels, and provide such data to microprocessor 55. The microprocessor is programmed to compare the data taken from the two encoders, and to present these data on display 56. Display 56 is the same as monitor 13 shown in the other figures.

The rowing trainer of the present invention therefore provides a device in which 1) the moving mass is minimized, 2) the oars realistically simulate the motion of oars in a boat, and 3) the seat is stationary. The moving mass is minimized, in part, by making both the seat and the flywheels stationary relative to the frame. It is only the rigger and oar assembly which slides back and forth.

The flywheel system of the present invention is illustrated as including a relatively massive wheel and a "squirrel cage" fan. Flywheels used in the prior art have included fans, as well as magnetic, fluid, and/or frictional resistance. The flywheels used in the present invention can be made with any or all of the foregoing constructions.

The rowing trainer of the present invention may be provided with covers (not shown) on the flywheels and cables to prevent injury, i.e. to prevent items of clothing, or body parts, from becoming caught in the moving parts of the device.

The rowing trainer of the present invention can be modified in various ways, as will be understood by the reader skilled in the art. For example, the transmission of energy from the oars to the flywheels could be varied. The parameters displayed on the monitor could be changed. The microprocessor could be programmed to provide a very detailed graphical and/or numerical summary of the movements of the simulated boat. All of the above modifications should be considered within the spirit and scope of the following claims.

What is claimed is:

1. A rowing trainer, comprising:

a) a frame, b) a seat affixed to the frame, wherein the seat does not slide relative to the frame when the rowing trainer is in use, c) a rigger which is slidable back and forth relative to the frame, d) the rigger supporting a foot rest which moves in a same direction back and forth with the rigger, e) an oar which is pivotably mounted to the rigger, f) a transmission, and g) a flywheel connected, through said transmission, to receive energy transmitted through the oar, wherein the rigger includes an outwardly extending arm, the outwardly extending arm being connected to an underframe arm, the underframe arm being connected to the flywheel.

2. The rowing trainer of claim 1, wherein the flywheel is attached to the frame and does not translate relative to the frame.

3. The rowing trainer of claim 1, further comprising means for sensing rotation of the flywheel, the sensing means being connected to a display means for displaying information, to a user, concerning operation of the rowing machine.

4. The rowing trainer of claim 3, wherein the display means comprises a monitor which is affixed to the frame, the monitor being positioned to be visible by a user located in a vicinity of the seat.

5. A rowing trainer, comprising:

a) a frame, b) a rigger disposed to slide back and forth along the frame, the rigger supporting at least one oar, the oar being pivotably mounted to the rigger, c) a seat affixed to the frame, the seat being stationary relative to the frame when the rowing trainer is in use, d) a foot rest supported by the rigger, wherein the foot rest moves in a same direction back and forth with the rigger, e) a flywheel connected to the frame, and f) means for transmitting energy from the oar to the flywheel, wherein the rigger includes an outwardly extending arm, the outwardly extending arm being connected to an underframe arm, the underframe arm being connected to the flywheel.

6. The rowing trainer of claim 5, wherein the flywheel is fixed relative to the frame.

7. The rowing trainer of claim 5, further comprising means for sensing rotation of the flywheel, the sensing means being connected to a display means for displaying information, to a user, concerning operation of the rowing machine.

8. The rowing trainer of claim 7, wherein the display means comprises a monitor which is affixed to the frame, the monitor being positioned to be visible by a user located in a vicinity of the seat.

9. The rowing trainer of claim 5, wherein the underframe arm moves in response to movements of the oar, the underframe arm having a first end which is mechanically connected to the oar and a second end which is not so connected, wherein the rowing machine includes a cord extending from the second end of the underframe arm, and around a castering pulley attached to the rigger, and around a pulley attached to the flywheel, the cord being attached to the frame.

10. A method of rowing training, comprising the steps of:

a) sitting on a seat which is affixed to a frame of a rowing machine, wherein the seat does not move relative to the frame while the method is performed, b) alternately pulling and pushing on an oar which is pivotably attached to a rigger, while pushing on a foot rest supported by the rigger, wherein the rigger and foot rest together slide along the frame during the pulling and pushing step, the rigger being attached to an underframe arm, wherein step (b) includes moving the underframe arm so as to pull a cord which is connected to a flywheel which is affixed to the frame.

11. The method of claim 10, further comprising measuring angular velocity of the flywheel, and displaying information related to said angular velocity on a screen which is visible to a user located in a vicinity of the seat.

12. The method of claim 10, wherein there are two flywheels, the method further comprising measuring angular velocities of the flywheels, and displaying information based on a comparison of said angular velocities, and displaying results of said comparison on a screen which is visible to a user located in a vicinity of the seat.

* * * * *